US006871587B2

(12) United States Patent
Kanamaru et al.

(10) Patent No.: US 6,871,587 B2
(45) Date of Patent: Mar. 29, 2005

(54) MACHINE PRESS

(75) Inventors: Hisanobu Kanamaru, Sagamihara (JP); Ito Takao, Sagamihara (JP); Hiromichi Fujimori, Tokyo (JP)

(73) Assignee: Aida Engineering Co., Ltd., Kanagawa (JP)

( * ) Notice: Subject to any disclaimer, the term of this patent is extended or adjusted under 35 U.S.C. 154(b) by 0 days.

(21) Appl. No.: 10/256,293

(22) Filed: Sep. 25, 2002

(65) Prior Publication Data

US 2003/0074948 A1 Apr. 24, 2003

(30) Foreign Application Priority Data

Oct. 24, 2001 (JP) ..... 2001-325942

(51) Int. Cl.[7] ..... B30B 1/00; B21J 13/04
(52) U.S. Cl. ..... 100/214; 72/455
(58) Field of Search ..... 100/214, 280, 100/281, 282, 283, 285, 286, 293, 295, 269.17; 72/455, 452.05, 456, 453.01

(56) References Cited

U.S. PATENT DOCUMENTS

| | | | | | |
|---|---|---|---|---|---|
| 3,523,444 | A | * | 8/1970 | Lucky | 72/453.05 |
| 3,858,432 | A | * | 1/1975 | Voorhees et al. | 72/455 |
| 4,095,522 | A | * | 6/1978 | Drungil | 100/214 |
| 4,397,232 | A | * | 8/1983 | Schockman et al. | 100/214 |
| 4,615,208 | A | * | 10/1986 | Hailey | 72/455 |
| 4,794,781 | A | * | 1/1989 | Shiga et al. | 72/455 |
| 4,947,673 | A | * | 8/1990 | Baranski | 72/456 |
| 5,027,638 | A | * | 7/1991 | Friestad | 72/455 |
| 5,052,257 | A | * | 10/1991 | Eigenmann | 83/530 |
| 5,746,123 | A | * | 5/1998 | Eigenmann | 100/208 |
| 6,012,322 | A | * | 1/2000 | Itakura | 72/450 |
| 6,018,971 | A | * | 2/2000 | Kleinschmidt | 72/61 |
| 6,055,903 | A | * | 5/2000 | Eigenmann | 100/257 |

FOREIGN PATENT DOCUMENTS

| | | | | |
|---|---|---|---|---|
| DE | 31 49 243 A1 | | 6/1983 | |
| EP | 0 256 570 A1 | | 2/1988 | |
| EP | 0 732 192 A2 | | 9/1996 | |
| JP | 09029499 A | * | 2/1997 | B30B/15/06 |
| JP | 2000-332509 | * | 4/2000 | B30B/15/04 |

OTHER PUBLICATIONS

Patent Abstracts of Japan for JP11–267897 published on Oct. 5, 1999.

Patent Abstracts of Japan for JP55–084299 published on Jun. 25, 1980.

* cited by examiner

*Primary Examiner*—Allen Ostrager
*Assistant Examiner*—Jimmy T Nguyen
(74) *Attorney, Agent, or Firm*—Darby & Darby

(57) ABSTRACT

A simple structure is provided for the frame by changing the orientation of the crank mechanism so as to orient the crankshaft longitudinally. More specifically, the structure includes two ring-shaped main plates are provided in the front and back and are connected by means of connector plates. An upwardly and downwardly movable slide for the machine press is provided in a space demarcated by four column portions of the ring-shaped main plates and a bolster is provided atop a bed of the ring-shaped main plates. A crankshaft oriented longitudinally is provided at the crown portion of the ring-shaped main plates, and the slide is moved upward and downward by a drive mechanism that includes the crankshaft.

13 Claims, 10 Drawing Sheets

MACHINE PRESS

TECHNICAL FIELD

The present invention relates to a machine press. The term "machine press" refers to those press machines wherein a press is driven by a mechanical drive mechanism. This includes presses driven by a crank mechanism, knuckle mechanism, or other link mechanism but excludes oil-pressure presses and other hydraulic presses.

BACKGROUND

The crankshaft of a machine press is oriented horizontally to harness the power to drive an automated device. The horizontal orientation is for reasons of position, rotational direction, and other factors. The crankshaft is integrated with a connecting rod so as to form a crank mechanism. In such cases, one drawback is that the connecting rod undulates vertically. Furthermore, vertical movement by the connecting rod causes the thrust load to be displaced vertically. To compensate for the displacement of the thrust load, the frame of the machine press is required to be much stronger longitudinally, usually by increasing the thickness of the press, so as to assure sufficient rigidity.

In multiprocess pressing, multiple processes are in general arranged side-by-side, and work pieces are fed from mold to mold laterally. The extent of the process load varies between processes this causes an eccentric load to occur in the frame in the lateral directions. The eccentric load acts on the frame as thrust load in the lateral directions, thus requiring the frame to have sufficient lateral rigidity.

To address both the longitudinal thrust load caused by undulation of the connecting rod and the lateral eccentric load caused by the press load, the frame of a machine press must be provided with sufficient rigidity in both the longitudinal and lateral directions. This is illustrated in the prior art. FIG. 3 of Unexamined Patent Application H8-174295 illustrates a frame having a thick shape longitudinally.

SUMMARY

Therefore, it is an object to provide a machine press having a simple frame. The recent application of servomotors in automated equipment has eliminated the need to power harness such equipment and reduced the need to orient the crankshaft laterally. The present invention configures a crank mechanism wherein the crankshaft is oriented longitudinally and is integrated with a connecting rod. Thus, the connecting rod now undulates in the lateral direction and therefore generate thrust load in the lateral direction, thereby eliminating the need for frame rigidity longitudinally.

A simple structure for the frame is provided by changing the orientation of the crank mechanism so as to orient the crankshaft longitudinally. More specifically, a structure is disclosed as having two ring-shaped main plates are provided in the front and back and are connected by means of connector plates. An upwardly and downwardly movable slide for the machine press is provided in a space demarcated by four column portions of the ring-shaped main plates and a bolster is provided atop a bed of the ring-shaped main plates. A crankshaft oriented longitudinally is provided at the crown portion of the ring-shaped main plates, and the slide is moved upward and downward by a drive mechanism that includes the crankshaft.

A link mechanism is also provided in the drive mechanism. There exist drive mechanisms that, when the crankshaft is oriented longitudinally, integrates various links along the crankshaft. The lateral thrust load that is generated by such drive mechanisms is addressed by the present device.

The present device also includes welding bed plates on the inside of the bed portion of the ring-shaped main plates. The bed plate increases the rigidity of the bed portion and thereby enables high-precision pressing.

In another embodiment, holes are provided for material insertion and extraction and affixing reinforcing plates to the ring-shaped main plates around the holes. These holes are located in a left portion and a right portion of the connector plates of the ring-shaped main plates. These holes minimize the extensions of the frame.

A further embodiment provides a stay that laterally connects the column portions of the ring-shaped main plates, thereby minimizing deformation of the frame and enabling the slide to be moved up and down with high precision.

Another embodiment includes two inverted U-shaped plates in the front and back and connected by connector plates. An upwardly and downwardly movable slide for the machine press is again provided in a space demarcated by four column portions of the inverted U-shaped plates. A bed is welded to the inside of the opening of the inverted U-shaped plates and a bolster is affixed atop the bed. A crankshaft oriented longitudinally is provided at the crown portion of the inverted U-shaped plates, and the slide is moved up and down by means of a drive mechanism that includes the crankshaft. The rigidity of the bed portion can be increased as desired. Deformation of the bolster can be reduced by shortening the longitudinal span defined by the bolster.

The above exemplary embodiments may further include a link mechanism in the drive mechanism. Additionally, holes for material insertion and extraction and affixing reinforcing plates to the ring-shaped main plates around the holes may be provided. These holes are located in a left portion and a right portion of the connector plates of the ring-shaped main plates. These holes minimize the extensions of the frame.

Moreover, the above embodiment may further provide a stay that laterally connects the column portions of the ring-shaped main plates.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENTS

Referring now to FIGS. 1 to 5, a frame 2 for a machine press 1 includes a crown portion 2*b*, column portions 2*c*, and a bed portion 2*a*. Frame 2 also includes main plates 2*d*, multiple connector plates 2*g*, 2*h*, 2*i*, and reinforcement plates 2*e*.

Figure 2:
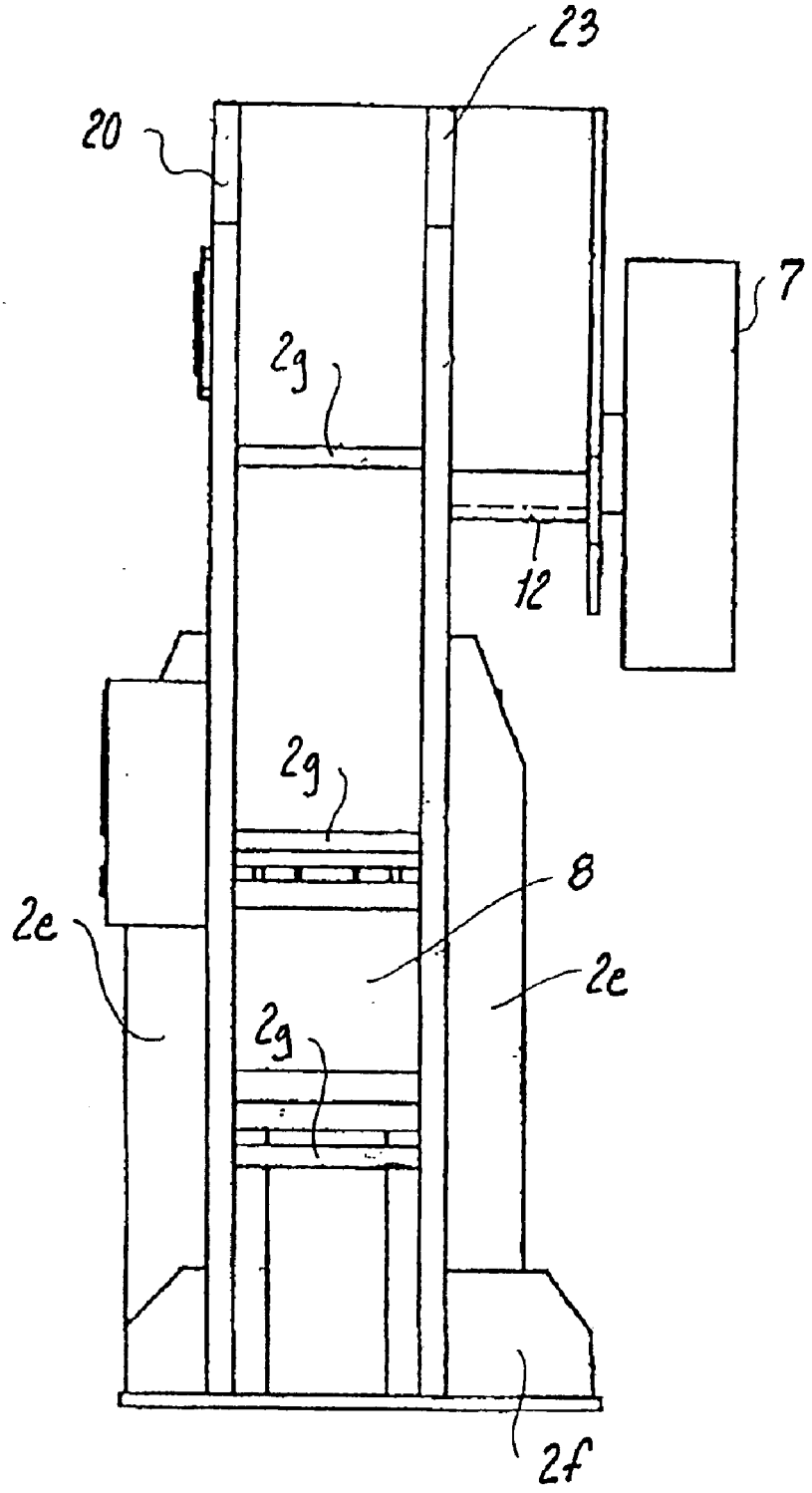
FIG. 2 is a right side view of a machine press according to the first embodiment.
Figure 3:
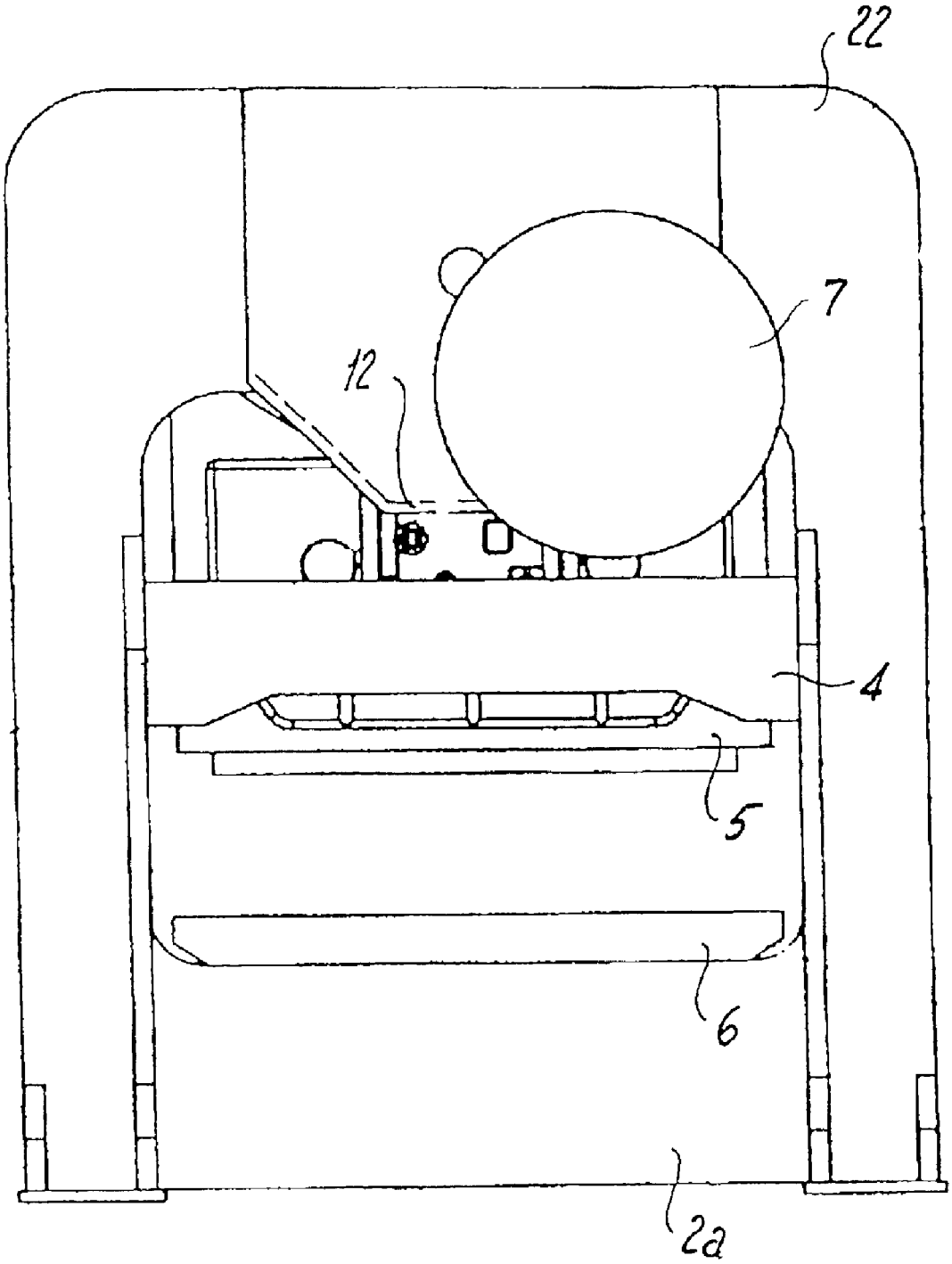
FIG. 3 is a rear view of a machine press according to the first embodiment.

Referring to FIGS. 2 and 3, frame 2 is fabricated by providing two main plates 2*d*, a front main plate 20 and a back main plate 22, connecting main plates 2*d* with connector plates 2*g*, 2*h*, 2*i*, providing reinforcing plates 2*e*, and affixing a stay 4. In a preferred embodiment, frame 2 is made of steel, and connector plates 2*g*, 2*h*, 2*i* are welded between front main plate 20 and back main plate 22 and reinforcing plates 2*e* are welded to an outside of the front main plate 20 and the back main plate 22. Stay 4 may be affixed to the main plates 2*d* by welding. However, in a preferred embodiment stay 4 is affixed by bolts. A lower portion of reinforcing plates 2*e* serve as legs to secure the machine press 1 to a foundation during installation. Other embodiments may omit one or more of connector plates 2*g*, 2*h*, 2*i*, reinforcing plates 2*e*, and stay 4 depending on the load requirements and design of machine press 1.

Referring to FIG. 2, each connector plate 2*g* has a hole for either the placement of feeding equipment or material insertion and extraction. Holes 8 reduce the longitudinal rigidity of the frame, so reinforcing plates 2*e* are welded to main plates 2*d* in the present embodiment. A control panel 9 is affixed to the outside of reinforcing plate 2*e* that is affixed to front main plate 20.

Figure 4:
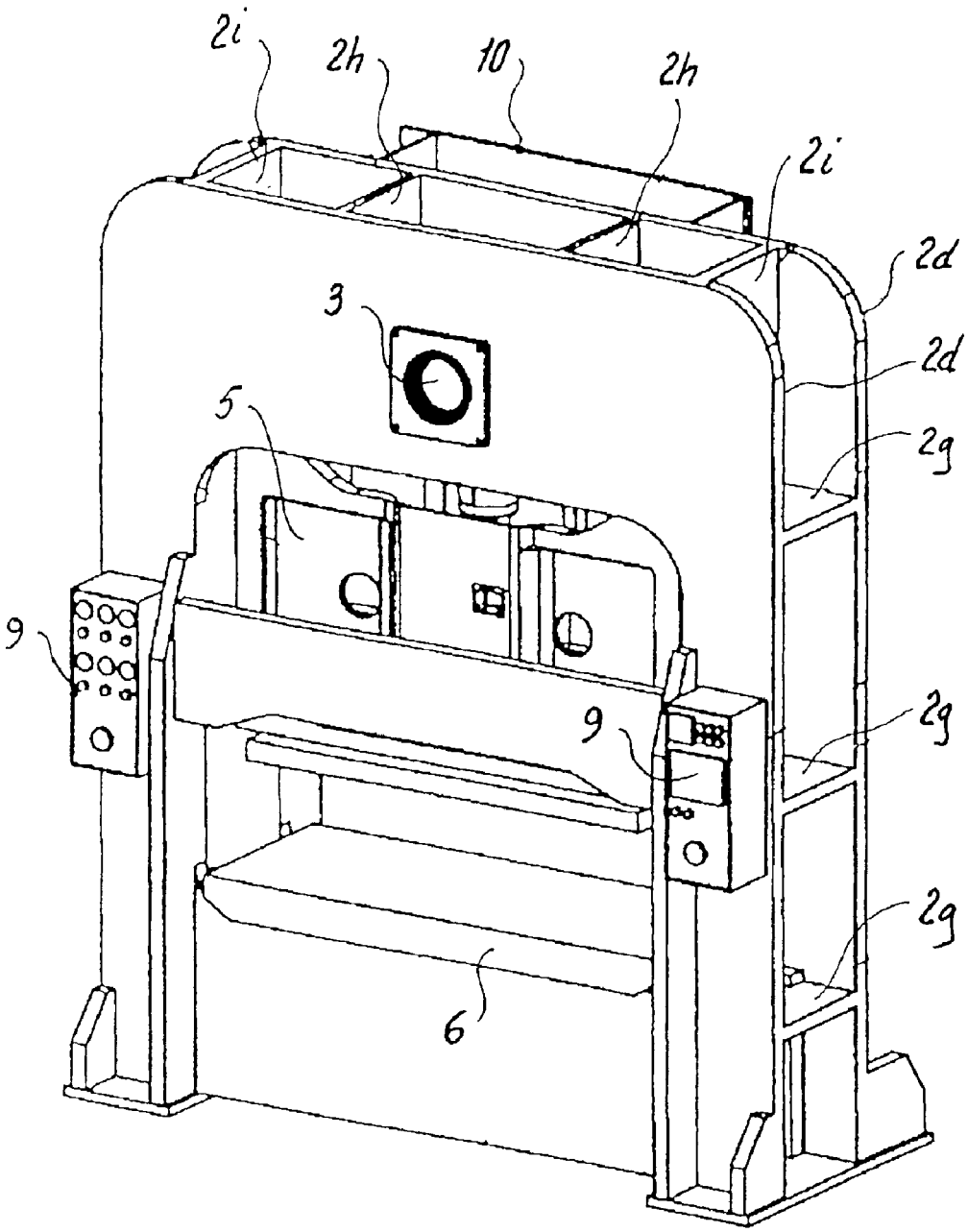
FIG. 4 is a front and side prospective view of a machine press according to the first embodiment.

FIG. 4 illustrates an upwardly and downwardly movable slide 5 that is provided in a space demarcated by four column portions 2*c*. Slide 5 is guided by means of guides (not illustrated) provided on column portions 2*c* and slide 5 moves up and down with high precision. Slide 5 is connected to a crankshaft 3 by connecting rods (not illustrated) and moved up and down by a crank mechanism (not illustrated).

Figure 1:
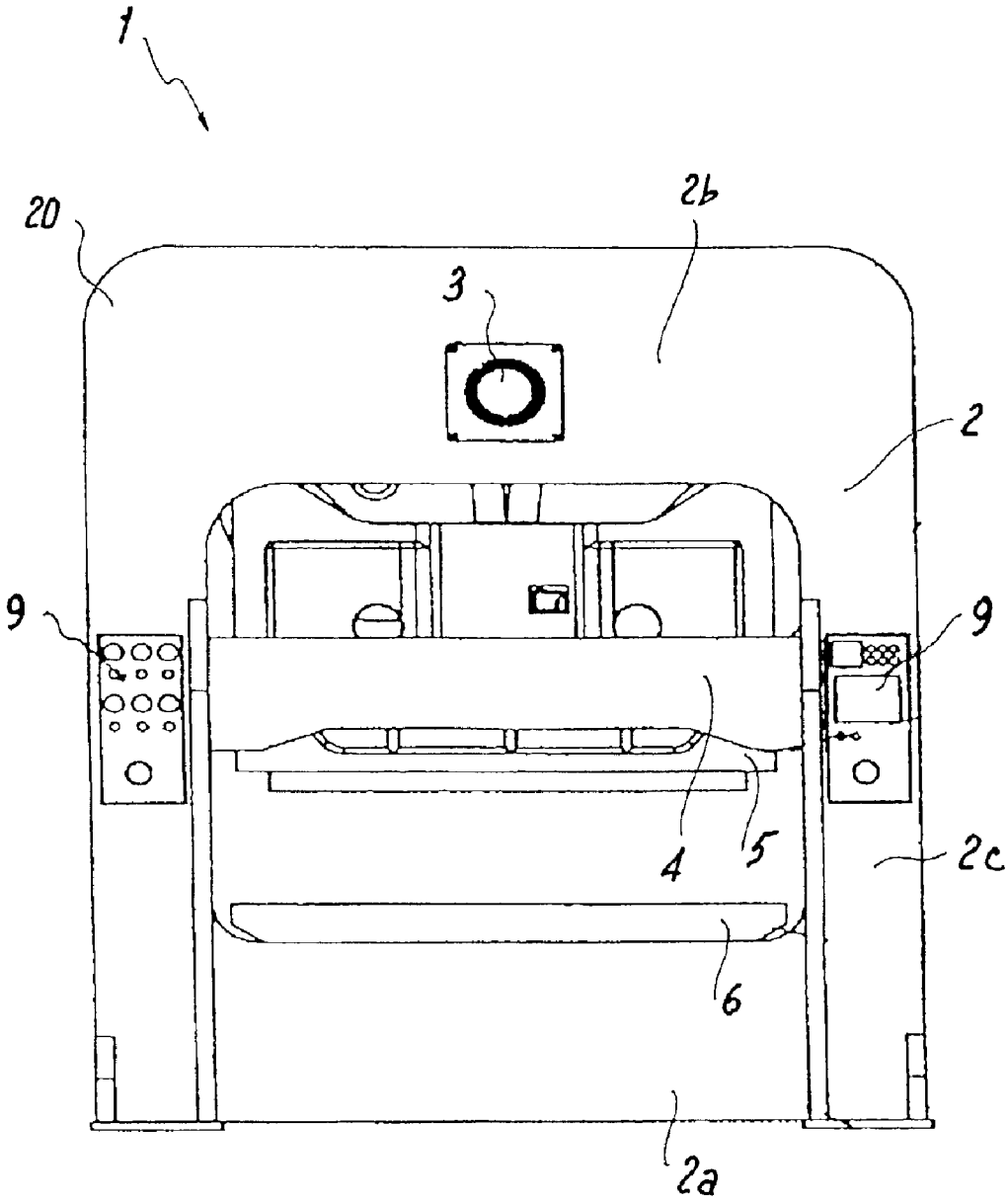
FIG. 1 is a front view of a machine press according to the first embodiment.
Figure 5:
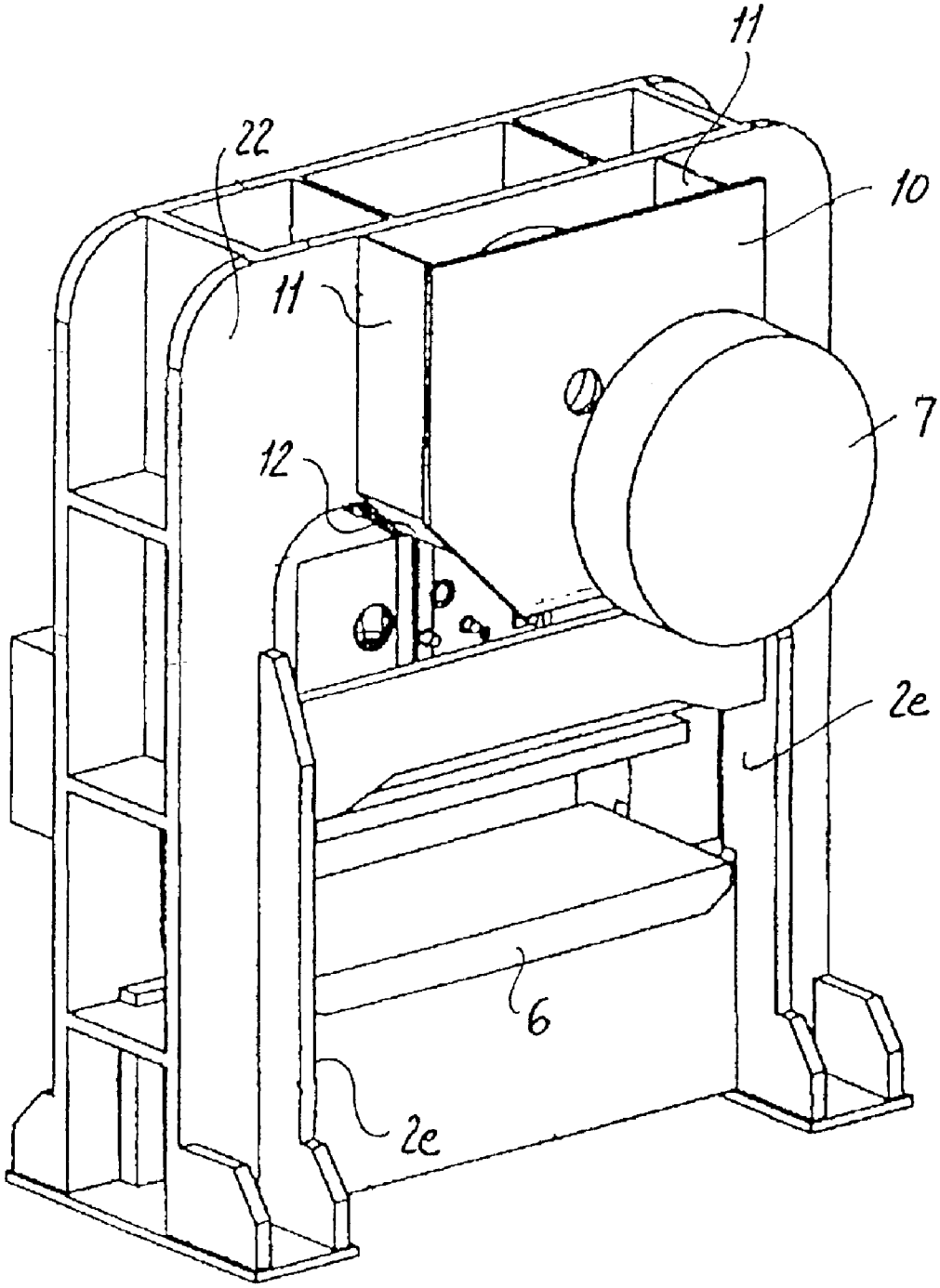
FIG. 5 is a rear and side perspective view of a machine press according to the first embodiment.

FIGS. 1 and 5 illustrate a bolster 6 affixed to bed portion 2*a* and an upper die (not illustrated) and a lower die (not illustrated) are affixed to a bottom of slide 5 and a top of bolster 6, respectfully. An article is then supplied between slide 5 and bolster 6 is pressed as a result of the movement of slide 5.

Referring now to FIG. 5, side plates 11 and a bottom plate 12 are provided on the back main plate 22, and a rear plate 10 is provided on the side plates 11 and bottom plate 12. Side plates 11, bottom plate 12, rear plate 10 and back main plate 22 form an interior space that contains shafts (not illustrated) and reduction gears (not illustrated) adapted to drive crankshaft 3. In a preferred embodiment, side plates 11, bottom plate 12, rear plate 10 and back main plate 22 are affixed by welding.

On the outside of the rear plate 10 is a flywheel 7 and a drive motor (not illustrated). Inside flywheel 7 is a clutch brake and although a combined clutch brake is employed in the present embodiment, it is apparent to those of skill in the art that a separate clutch brake may be employed. Additionally, a crank angle indicator (not illustrated) may be included on a front of crankshaft 3.

Figure 10:
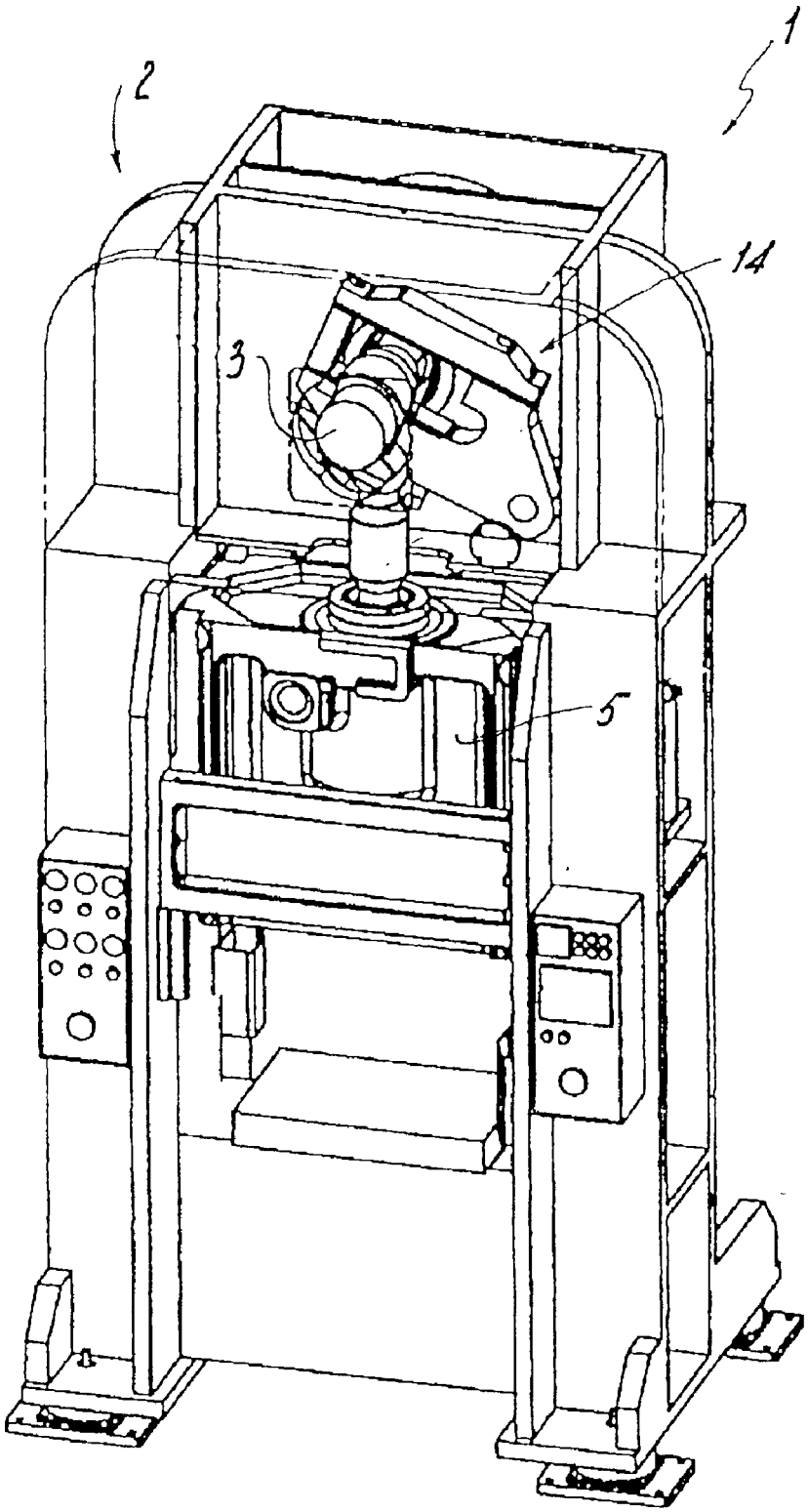
FIG. 10 is a front and side perspective view of the present device with a link exposed.

FIG. 10 illustrates a link drive mechanism 14. Link drive mechanism 14 is described in Unexamined Patent Application 2000-219980. A pair of sliders 5, which support the eccentric portion of the crankshaft 3, are guided along grooves (not illustrated) provided in the arm (not illustrated) so as to allow slide 5 to slide. One end of the arm is attached by a pin (not illustrated) to frame 2 of machine press 1 allow the arm to rotate. An upper end and lower end of a rod (not illustrated) are respectively connected to the lower end of the arm and to slide 5. The upper and lower ends of the rod are connected to the respective members so as to swivel.

When crankshaft 3 rotates, the arm swings and slide 5 moves up or down through the rod. The downward movement of slide 5 is slow and the upward movement is rapid. This type of movement cycle is effective for pressing materials.

FIGS. 4 and 5 illustrate connector plates 2*g*, 2*h*, 2*i* and the other members of the machine press 1 are shown exposed but the preferred embodiment they would be covered to prevent entry of dust and debris.

Figure 6:
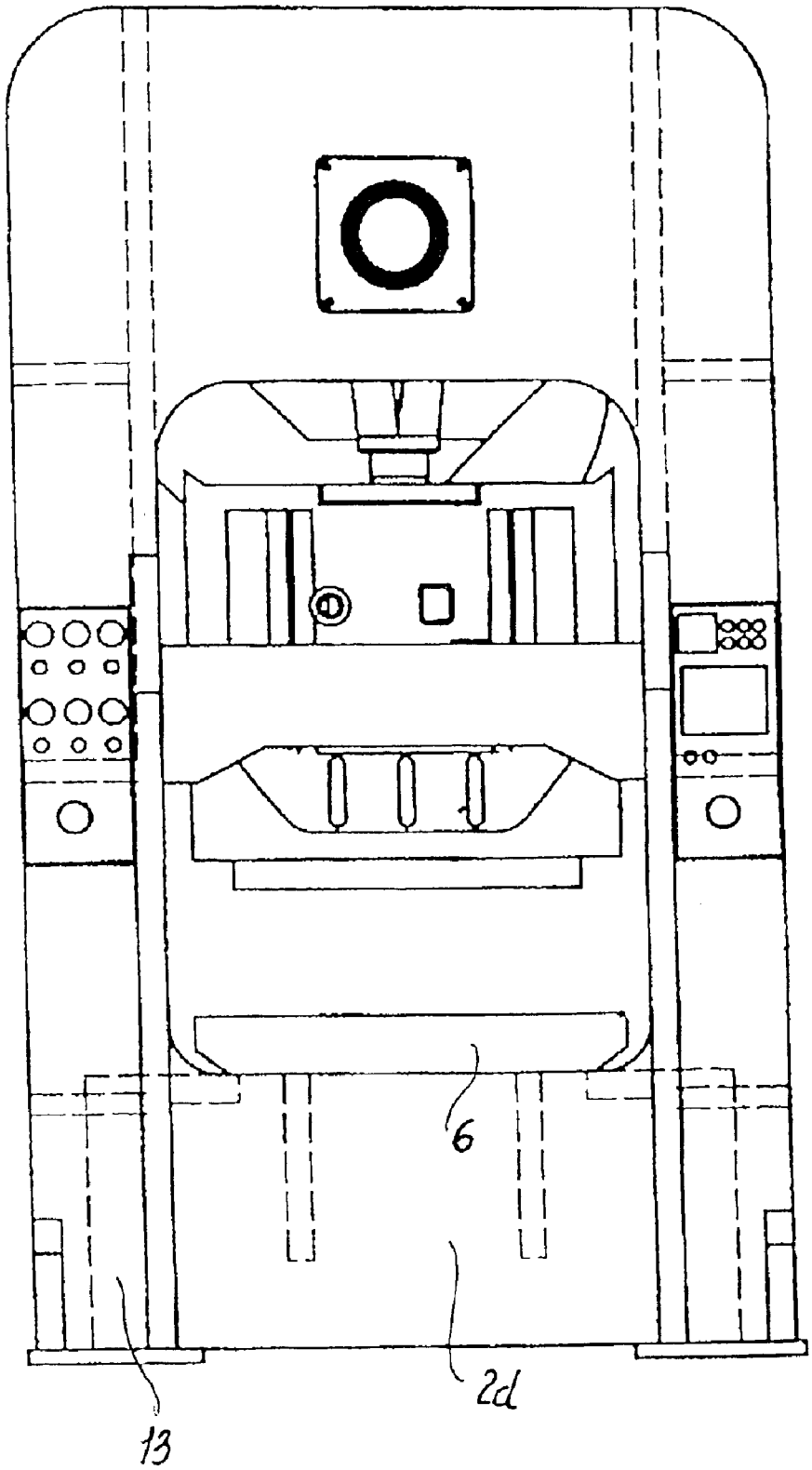
FIG. 6 is a front view of a machine press according to a second embodiment.
Figure 7:
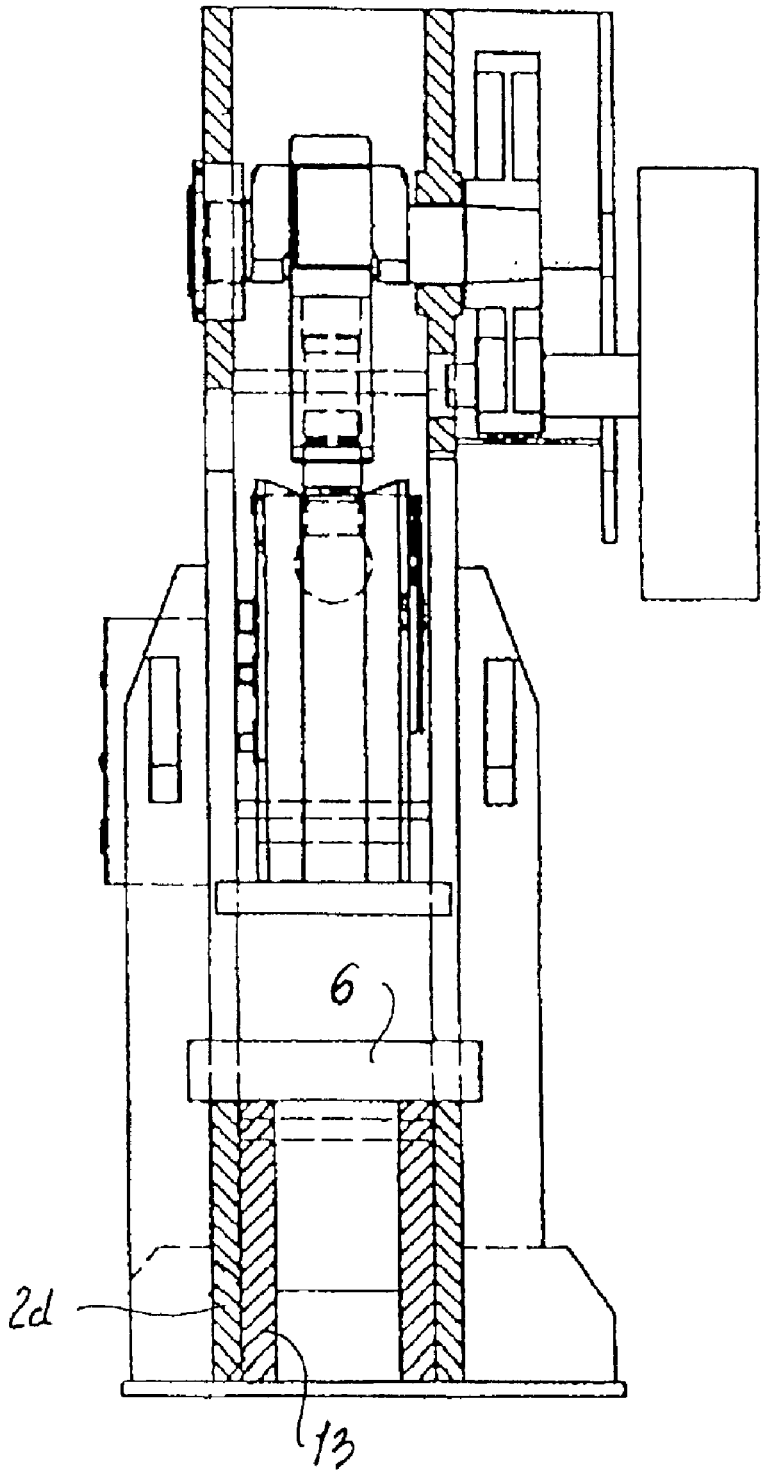
FIG. 7 is a right side view of a machine press according to the second embodiment.

In the preferred embodiment, main plates 2*d* are ring-shaped, a single plate with a hole in the center thereof. The shape of main plates 2*d* are designed to naturally bear the press load. In a second embodiment, a single plate is welded to the inside of main plates 2*d* to further increase the rigidity of bed portion 2*a*. As illustrated in FIGS. 6 and 7, a bed plate 13 is welded to the inside of main plate 2*d* and bolster 6 is affixed atop the bed plate 13.

In a third embodiment, ring-shaped main plates 2*d* are now an inverted U-shaped plate 102*d*, and a bed 102*a* is welded to the inside of a front inverted U-shaped plate 102*e* and a back inverted U-shaped plate 102*f*.

Figure 8:
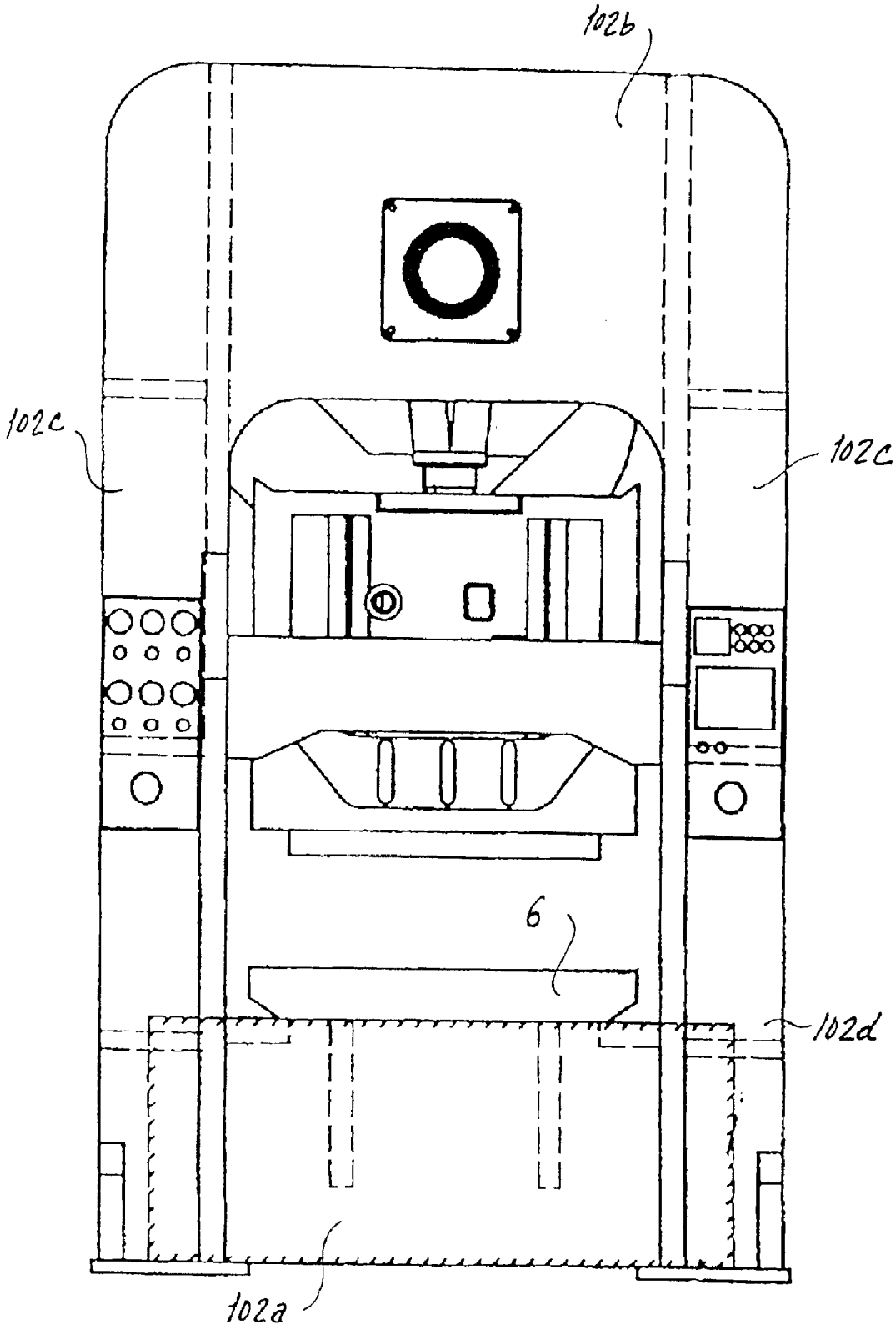
FIG. 8 is a front view of a machine press according to the second embodiment.
Figure 9:
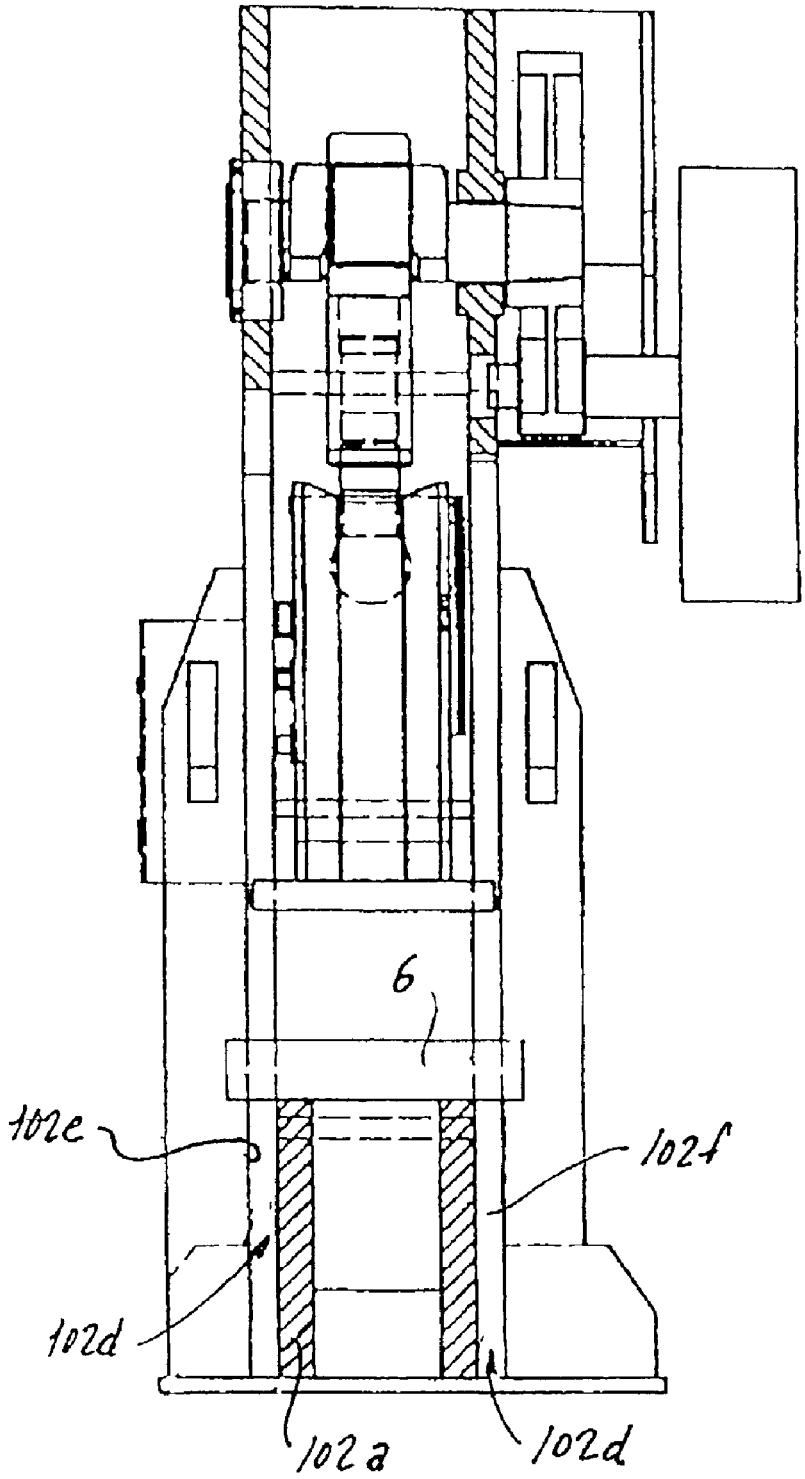
FIG. 9 is a right side view of a machine press according to the second embodiment.

Referring now to FIGS. 8 and 9, bed 102*a* is located between inverted U-shaped plates 102*d*. In the current embodiment, bed 102*a* is welded to inverted U-shaped plates 102*d*. The thickness of the plates for bed 102*a* may be selected without being restricted by the thickness of inverted U-shaped plates 102*d*. Bolster 6 is secured atop bed 102*a* and the longitudinal span defined by bolster 6, located inside inverted U-shaped plates 102*d*, may be made shorter than the span in the first or second embodiments.

Other than the opening in the lower portion, inverted U-shaped plates 102*d* are the same as ring-shaped main plates 2*d*. Therefore, inverted U-shaped plates 102*d* have a crown 102*b* and columns 102*c* similar to those of the ring-shaped main plates 2*d*.

The present device is capable of providing a simple machine press capable of withstanding the thrust load of the drive mechanism and the eccentric load of the press. In particular, the device according to third embodiment has a narrow longitudinal span in the bed and is capable of minimizing deformation of the bolster.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A machine press comprising:

a frame including:

a front ring-shaped main plate that is formed as a single plate and includes, at an upper end thereof, corners having a radius of curvature;

a back ring-shaped main plate that is formed as a single plate and includes, at an upper end thereof, corners having a radius of curvature;

a plurality of connector plates coupling the front ring-shaped main plate and the back ring-shaped main plate;

such that the front and back ring-shaped main plates include side column portions that define a frame opening through which material to be pressed is inserted;

the front and back ring-shaped main plates having a crown portion and a bed portion;

a slide disposed in the frame opening between the column portions;

a bolster disposed above the bed portion;

a drive mechanism including a crankshaft for driving the slide in up and down directions; and said crankshaft disposed proximate to the crown portion and orientated perpendicular to a transverse axis of the frame opening, wherein the transverse axis extends through the side columns.

2. The machine press of claim 1, wherein the bed portion includes a bed plate disposed on an inside of the bed portion.

3. The machine press of claim 1, further including:

a stay laterally connecting the column portions.

4. The machine press of claim 1, wherein the drive mechanism includes a link mechanism.

5. The machine press of claim 1, wherein the front ring-shaped main plate, the back ring-shaped main plate, and the connecting plates are welded together to form an integral structure.

6. The machine press of claim 1, wherein the front ring-shaped main plate, the back ring-shaped main plate, and the connecting plates are bolted together.

7. A machine press comprising:

a frame including:

a front ring-shaped main plate;

a back ring-shaped main plate;

a plurality of connector plates coupling the front ring-shaped main plate and the back ring-shaped main plate;

such that the front and back ring-shaped main plates include side column portions that define a frame opening through which material to be pressed is inserted;

the front and back ring-shaped main plates having a crown portion and a bed portion;

a slide disposed in the frame opening between the column portions;

a bolster disposed above the bed portion;

a drive mechanism including a crankshaft for driving the slide in up and down directions; and said crankshaft disposed proximate to the crown portion and orientated perpendicular to a transverse axis of the frame opening, wherein the transverse axis extends through the side columns, wherein each connector plate has an opening formed therethrough which communicates with the frame opening to permit material insertion and extraction and wherein reinforcing plates are affixed to the front and back ring-shaped main plates, the reinforcing plates being formed around the opening formed in the connector plate.

8. A machine press comprising:

a frame including:

an inverted front U-shaped main plate that is formed as a single plate and includes, at an upper end thereof, corners having a radius of curvature;

an inverted back U-shaped main plate that is formed as a single plate and includes, at an upper end thereof, corners having a radius of curvature;

a plurality of connector plates coupling the inverted front U-shaped main plate and the inverted back U-shaped main plate;

such that the inverted front and back U-shaped main plates include column portions that define a frame opening through which material to be pressed is inserted;

the inverted front and back U-shaped main plates having a crown portion and a bed portion being coupled to an inside of the frame opening;

a slide disposed in the frame opening between the column portions;

a bolster disposed above the bed portion; and a drive mechanism including a crankshaft for driving the slide in up and down directions; and said crankshaft disposed proximate to the crown portion and orientated perpendicular to a transverse axis of the frame opening, wherein the transverse axis extends through the side columns.

9. A machine press of claim 8, wherein each connector plate has an opening formed therethrough which communicates with the frame opening to permit material insertion and extraction and wherein reinforcing plates are affixed to the front and back U-shaped main plates, the reinforcing plates being formed around the opening formed in the connector plate.

10. The machine press of claim 8, further including:

a stay laterally connecting the column portions.

11. The machine press of claim 8, wherein the drive mechanism includes a link mechanism.

12. The machine press of claim 8, wherein the front U-shaped main plate, the back U-shaped main plate, and the connecting plates are welded together to form an integral structure.

13. The machine press of claim 8, wherein the front U-shaped main plate, the back U-shaped main plate, and the connecting plates are bolted together.

* * * * *